US010627731B2

(12) United States Patent
Ikeda

(10) Patent No.: US 10,627,731 B2
(45) Date of Patent: Apr. 21, 2020

(54) TONER, TONER CONTAINER, DEVELOPING UNIT, IMAGE FORMING APPARATUS, AND TONER MANUFACTURING METHOD

(71) Applicant: Oki Data Corporation, Tokyo (JP)

(72) Inventor: Naoya Ikeda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/251,877

(22) Filed: Jan. 18, 2019

(65) Prior Publication Data

US 2019/0235401 A1 Aug. 1, 2019

(30) Foreign Application Priority Data

Jan. 31, 2018 (JP) ..... 2018-014822

(51) Int. Cl.
*G03G 9/08* (2006.01)
*G03G 9/087* (2006.01)
*G03G 9/09* (2006.01)

(52) U.S. Cl.
CPC ..... *G03G 9/0804* (2013.01); *G03G 9/0806* (2013.01); *G03G 9/08755* (2013.01); *G03G 9/08795* (2013.01); *G03G 9/08797* (2013.01); *G03G 9/0906* (2013.01); *G03G 9/0926* (2013.01)

(58) Field of Classification Search
CPC ..... G03G 9/0906; G03G 9/0926
USPC ..... 430/108.1, 110.4
See application file for complete search history.

(56) References Cited

U.S. PATENT DOCUMENTS

2010/0062352 A1 3/2010 Kusahara et al.
2011/0143278 A1 6/2011 Iftime et al.
2015/0030975 A1 1/2015 Takano

FOREIGN PATENT DOCUMENTS

EP 3136178 A1 3/2017
JP 2015025929 A 2/2015
JP 2015049322 A 3/2015

OTHER PUBLICATIONS

Annex to the European Seach Report dated May 8, 2019 in EP Application No. 19152691.

*Primary Examiner* — Mark A Chapman
(74) *Attorney, Agent, or Firm* — Panitch Schwarze Belisario & Nadel LLP

(57) ABSTRACT

A toner includes toner base particles each including a toner base particle and an external additive. The toner base particle includes a fluorescent pigment and a binder resin. The external additive is fixed on a surface of the toner base particle. The content of the fluorescent pigment in the toner base particle is equal to or greater than 0.3 weight percent and equal to or smaller than 3.0 weight percent. A ratio of a particle size distribution on a number basis of the toner particles to a particle size distribution on a volume basis of the toner particles is equal to or greater than 0.66 and equal to or smaller than 1.00.

10 Claims, 2 Drawing Sheets

TONER, TONER CONTAINER, DEVELOPING UNIT, IMAGE FORMING APPARATUS, AND TONER MANUFACTURING METHOD

CROSS REFERENCE TO RELATED APPLICATIONS

The present application claims priority from Japanese Patent Application No. 2018-014822 filed on Jan. 31, 2018, the entire contents of which are hereby incorporated by reference.

BACKGROUND

The technology relates to a toner that includes a fluorescent pigment, a toner container using the toner, a developing unit using the toner, an image forming apparatus using the toner, and a toner manufacturing method.

An electrophotographic image forming apparatus has become widely used. The widespread use of the electrophotographic image forming apparatus is owing to its capability of forming a vivid image in a shorter time than other types of image forming apparatuses such as inkjet image forming apparatuses do.

The electrophotographic image forming apparatus forms an image on a print medium using a toner. In a process of forming the image, the toner attached to an electrostatic latent image is transferred onto the print medium, and thereafter, fixed to the print medium.

In order to form a luminescent image, a luminescent toner containing a fluorescent pigment is used. Various proposals have been made for the luminescent toner containing the fluorescent pigment.

For example, to suppress so-called fogging, a luminescent toner is manufactured using a fluorescent pigment or a fluorescent substance dissolved in ethyl acetate by means of a dissolution suspension method, without the use of a pigment dispersant. The amount of the fluorescent pigment dissolved in the ethyl acetate is adjusted within a predetermined range. Reference is made to Japanese Unexamined Patent Application Publication No. 2015-025929, for example.

SUMMARY

Various studies have been made on a luminescent toner; however, the quality of an image formed using the luminescent toner has not been sufficiently high yet, which still leaves room for improvement.

It is desirable to provide a toner, a toner container, a developing unit, an image forming apparatus, and a toner manufacturing method that each make it possible to form a high-quality luminescent image.

According to one embodiment of the technology, there is provided a toner that includes a plurality of toner particles. The toner particles each includes a toner base particle including a fluorescent pigment and a binder resin, and an external additive fixed on a surface of the toner base particle. The content of the fluorescent pigment in the toner base particle is equal to or greater than 0.3 weight percent and equal to or smaller than 3.0 weight percent. The ratio of a particle size distribution on a number basis of the toner particles to a particle size distribution on a volume basis of the toner particles is equal to or greater than a 0.66 and equal to or smaller than 1.00.

According to one embodiment of the technology, there is provided a toner container that has a container section containing a toner. The toner includes a plurality of toner particles. The toner particles each includes a toner base particle including a fluorescent pigment and a binder resin, and an external additive fixed on a surface of the toner base particle. The content of the fluorescent pigment in the toner base particle is equal to or greater than 0.3 weight percent and equal to or smaller than 3.0 weight percent. The ratio of a particle size distribution on a number basis of the toner particles to a particle size distribution on a volume basis of the toner particles is equal to or greater than 0.66 and equal to or smaller than 1.00.

According to one embodiment of the technology, there is provided a developing unit that includes a toner container and a developing process section that performs a developing process using the toner contained in the toner container. The toner includes a plurality of toner particles. The toner particles each includes a toner base particle including a fluorescent pigment and a binder resin, and an external additive fixed on a surface of the toner base particle. The content of the fluorescent pigment in the toner base particle is equal to or greater than 0.3 weight percent and equal to or smaller than 3.0 weight percent. The ratio of a particle size distribution on a number basis of the toner particles to a particle size distribution on a volume basis of the toner particles is equal to or greater than 0.66 and equal to or smaller than 1.00.

According to one embodiment of the technology, there is provided an image forming apparatus that includes: a developing unit; a transfer section that performs a transfer process using the toner on which the developing process has been performed by the developing unit; and a fixing section that performs a fixing process using the toner on which the transfer process has been performed by the transfer section. The toner includes a plurality of toner particles. The toner particles each includes a toner base particle including a fluorescent pigment and a binder resin, and an external additive fixed on a surface of the toner base particle. The content of the fluorescent pigment in the toner base particle is equal to or greater than 0.3 weight percent and equal to or smaller than 3.0 weight percent. The ratio of a particle size distribution on a number basis of the toner particles to a particle size distribution on a volume basis of the toner particles is equal to or greater than 0.66 and equal to or smaller than 1.00.

According to one embodiment of the technology, there is provided a toner manufacturing method. The toner manufacturing method includes: forming toner base particles using a dissolution suspension method, the toner base particles each including a fluorescent pigment and a binder resin, a content of the fluorescent pigment in the toner base particle being equal to or greater than 0.3 weight percent and equal to or smaller than 3.0 weight percent; and fabricating a toner including a plurality of toner particles by fixing an external additive on a surface of each of the toner base particles, the plurality of toner particles each including the toner base particle and the external additive.

DETAILED DESCRIPTION

Figure 1:
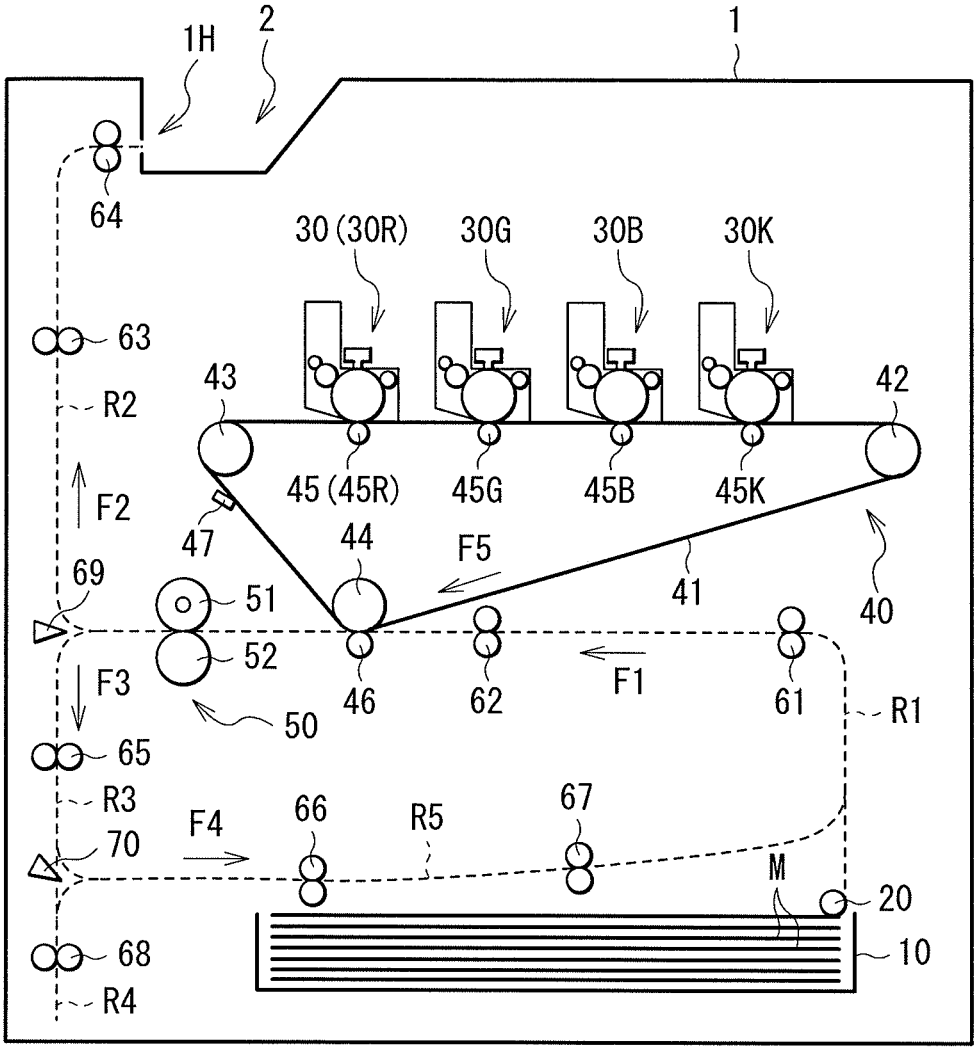
FIG. 1 is a plan view of an image forming apparatus having an example configuration according to one example embodiment of the technology.

Hereinafter, some example embodiments of the technology will be described in detail with reference to the drawings. Note that the following description is directed to illustrative examples of the technology and not to be construed as limiting to the technology. Factors including, without limitation, numerical values, shapes, materials, components, positions of the components, and how the components are coupled to each other are illustrative only and not to be construed as limiting to the technology. Further, elements in the following example embodiments which are not recited in a most-generic independent claim of the technology are optional and may be provided on an as-needed basis. The drawings are schematic and are not intended to be drawn to scale. Note that the like elements are denoted with the same reference numerals, and any redundant description thereof will not be described in detail. The description will be given in the following order.

1. Toner
1-1. Outline Configuration
1-2. Detailed Configuration
1-3. Manufacturing Method
1-4. Example Workings and Example Effects
2. Image Forming Apparatus (Toner Container and Developing Unit)
2-1. Overall Configuration
2-2. Configuration of Developing Unit
2-3. Operation
2-4. Example Workings and Example Effects
3. Modification Examples

[1. Toner]

A description is given first of a toner according to an example embodiment of the technology.

The toner described herein may be used to form a luminescent image. In other words, the toner described herein may be a luminescent toner that includes a fluorescent pigment.

The luminescent toner may be used in any application without limitation. For example, the luminescent toner may be used in an electrophotographic image forming apparatus as described below. Non-limiting examples of the electrophotographic image forming apparatus may include a laser printer. The luminescent toner used in the laser printer may be, for example, a so-called electrostatic development toner.

Note that the luminescent toner may be, for example, a negatively-charged toner for single-component development. In other words, the luminescent toner may have a negative charging polarity, for example. The single-component development refers to development that involves imparting an appropriate amount of electric charge to the luminescent toner without the use of a carrier, such as a magnetic particle, that imparts electric charge to the luminescent toner. In contrast, two-component development refers to development that involves imparting an appropriate amount of electric charge to the luminescent toner with the use of a mixture of the carrier described above and the luminescent toner utilizing friction between the carrier and the luminescent toner.

The luminescent toner may have any fluorescent color derived from the fluorescent pigment without limitation. Specific but non-limiting examples of the color of the luminescent toner may include red, green, and blue.

[1-1 Outline Configuration]

A description is given first of an example outline configuration of the luminescent toner.

The luminescent toner includes a plurality of toner particles (i.e., particulate toner). The toner particles each include a toner base particle and an external additive.

[Toner Base Particle]

The toner base particle may be a base of the toner particle. The toner base particle includes a fluorescent pigment and a binder resin.

[Fluorescent Pigment]

The fluorescent pigment may include one or more of materials that emit light of a predetermined color through a luminous phenomenon. For example, the fluorescent pigment may be a material that emits fluorescent light of a predetermined color depending on absorption of ultraviolet light and that is insoluble in a solvent such as an organic solvent. In other words, the fluorescent pigment may have fluorescent characteristics and insolubility.

Non-limiting examples of the fluorescent pigment emitting red light may include Sinloihi color FZ-2000 series (FZ-2003), FZ-5000/FZ-6000 series (FZ-6013), FZ-3040 series (FZ-3043), FA-40 series (FA-43), and FA-200 series (FA-203) available from Sinloihi Co., Ltd, located in Kanagawa, Japan. Non-limiting examples of the fluorescent pigment emitting green light may include Sinloihi color FZ-5000/FZ-6000 (FZ-5012) and FA-200 series (FA-202) available from Sinloihi Co., Ltd, located in Kanagawa, Japan. Non-limiting examples of the fluorescent pigment emitting blue light may include Sinloihi color FZ-5000/FZ-6000 series (FZ-SB) and FA-40 series (FA-48) available from Sinloihi Co., Ltd, located in Kanagawa, Japan.

The luminescent toner that includes the fluorescent pigment emitting red light may be a so-called red toner. The red light may have any wavelength without limitation. The red light may have, for example but not limited to, a wavelength within a range from about 620 nm to about 750 nm.

The luminescent toner that includes the fluorescent pigment emitting green light may be a so-called green toner. The green light may have any wavelength without limitation. The green light may have, for example but not limited to, a wavelength within a range from about 495 nm to about 570 nm.

The luminescent toner that includes the fluorescent pigment emitting blue light may be a so-called blue toner. The blue light may have any wavelength without limitation. The blue light may have, for example but not limited to, a wavelength within a range from about 450 nm to about 495 nm.

[Binder Resin]

The binder resin may include one or more materials that bind substances, such as the fluorescent pigments, with each other. The binder resin may include one or more of polymer compounds including a polyester-based resin, a styrene-acrylic-based resin, an epoxy-based resin, and a styrene-butadiene-based resin. The polymer compound may have any crystalline form without limitation. The polymer compound may be, for example but not limited to, a crystalline polymer compound or an amorphous polymer compound.

The term "polyester-based resin" as used herein collectively refers to polyester and a derivative thereof. Likewise, a material having a term including "-based" collectively refers to the material itself and its derivative. Such a definition of the term with "-based" is also applicable to resin, wax, and complexes described later each having a term including "-based".

In one example, the binder resin may include the polyester-based resin. In another example, the binder resin may include polyester. Such binder resin that includes the polyester-based resin or polyester helps to facilitate the formation of a luminescent image having a smooth surface and helps to suppress variations in density of the luminescent image.

[Other Materials]

The toner base particle may include one or more additional materials. The additional material may be any material without limitation. Specific but non-limiting examples of the additional material may include a release agent and an electric charge control agent.

The release agent may improve properties, such as fixity and offset resistance, of the luminescent toner. The release agent may include one or more of waxes including an aliphatic-hydrocarbon-based wax, an oxide of aliphatic-hydrocarbon-based wax, a fatty-acid-ester-based wax, and a deoxide of fatty-acid-ester-based wax. Alternatively, the release agent may be a block copolymer that includes any two or more of the waxes described above, for example.

Non-limiting examples of the aliphatic-hydrocarbon-based wax may include low-molecular polyethylene, low-molecular polypropylene, a copolymer of olefin, a microcrystalline wax, a paraffin wax, and Fischer-Tropsch wax. Non-limiting examples of the oxide of aliphatic-hydrocarbon-based wax may include an oxidized polyethylene wax. Non-limiting examples of the fatty-acid-ester-based wax may include a carnauba wax and a montanic acid ester wax. The deoxide of fatty-acid-ester-based wax may be a partially-deoxidized or fully-deoxidized fatty-acid-ester-based wax. Non-limiting examples of the deoxide of fatty-acid-ester-based wax may include a deoxidized carnauba wax.

The electric charge control agent may control characteristics, such as triboelectric charging characteristics, of the luminescent toner. The electric charge control agent to be used in a negatively-charged luminescent toner may include one or more of complexes including an azo-based complex, a salicylic-acid-based complex, and a calixarene-based complex.

[External Additive]

The external additive may suppress aggregation of the luminescent toner and thereby improve fluidity of the luminescent toner. The external additive is fixed on a surface of the toner base particle. The external additive may include one or more types of hydrophobic particles.

For example, the hydrophobic particles may include an inorganic material and an organic material. The inorganic material may include hydrophobic silica, for example. The organic material may include a melamine resin, for example.

[1-2. Detailed Configuration]

A description is given below of a detailed configuration of the luminescent toner.

In one example where the luminance image is formed on the print medium using the image forming apparatus mounted with the luminescent toner described below with reference to FIG. 1, a content (wt %) of the fluorescent pigment and a ratio between two types of particle size distributions may be appropriately adjusted, as described below, to improve the quality of the luminescent image.

[Content of Fluorescent Pigment]

In one example, the content of the fluorescent pigment in the toner base particle may be within a range from about 0.3 wt % to about 3.0 wt %. In another example, the content of the fluorescent pigment in the toner base particle may be within a range from about 0.5 wt % to about 3.0 wt %. The luminescent toner that includes the fluorescent pigment in such an adjusted amount exhibits high luminescent characteristics and high light fastness, while ensuring electric charging characteristics.

In detail, in a case where the content of the fluorescent pigment is smaller than 0.3 wt %, such an excessively small absolute amount of the fluorescent pigment in the toner base particle can result in insufficient light-emission intensity or density, which is likely to decrease over time. In contrast, in a case of the content of the fluorescent pigment is not smaller than 0.3 wt %, such a sufficient absolute amount of the fluorescent pigment in the toner base particle ensures sufficiently high light-emission intensity, which is unlikely to decrease over time.

In one example, the content of the fluorescent pigment may be about 0.5 wt %. Such a greater absolute amount of the fluorescent pigment in the toner base particle increases the light-emission intensity, which is unlikely to decrease over time.

On the other hand, in a case where the content of the fluorescent pigment is greater than 3.0 wt %, such an excessively great absolute amount of the fluorescent pigment in the toner base particle is likely to cause excess electric charging of the luminescent toner. In the formation of a luminescent image on a print medium using such a luminescent toner, the luminescent toner can be fixed to a predetermined region in which the luminescent image is to be formed and also can be unintentionally fixed to an excess region other than the predetermined region. In contrast, in a case where the content of the fluorescent pigment is not greater than 3.0 wt %, such an appropriately adjusted absolute amount of the fluorescent pigment in the toner base particle is unlikely to cause the excess electric charging of the luminescent toner. This allows the luminescent toner to be fixed to the predetermined region of the print medium in which the luminescent image is to be formed, while suppressing or preventing the luminescent toner from being fixed to the excess region.

It is apparent from the above description that the use of the fluorescent pigment in a content within a range from about 0.3 wt % to about 3.0 wt % suppresses excess electric charging of the luminescent toner and ensures sufficient light-emission intensity, while suppressing a decrease in the light-emission intensity over time. Accordingly, it is possible to achieve high luminescent characteristics and high light fastness, while ensuring electric charging characteristics.

The content of the fluorescent pigment may be calculated on the basis of the toner base particles. The toner base particles may be collected by removing the external additive from each of the toner particles, as described below. An example procedure for the calculation is described in detail below.

To calculate the content of the fluorescent pigment, the toner particles may be processed first. For example, the toner particles may be added and stirred in a solvent, which may be Emulgen (registered trademark) 109P at a concentration of 5%, available from Kao Corporation, located in Tokyo, Japan. Thereafter, the solvent containing the toner particles may be subjected to ultrasound irradiation and thereby further stirred. The ultrasonic irradiation may be performed under any condition without limitation. In one example, the ultrasonic irradiation may be performed with an irradiation intensity of 40 kHz for ten minutes. Through the ultrasonic irradiation, the external additive may be removed from each of the toner particles, and the toner base particles may be thereby collected. Thereafter, a weight M1 of the collected toner base particles may be measured. In this measurement, the value of the weight M1 may be rounded to one decimal place. For confirmation of the status of removal of the external additive, an elemental analysis of the toner base particles may be performed to observe a residual amount of a constituent, such as silicon, of the external additive, using, for example, a fluorescence X-ray spectrometer, which may be EDX-80011S available from Shimadzu Corporation, located in Kyoto, Japan.

Thereafter, the toner base particles may be added and stirred in an organic solvent. The organic solvent is described in detail below. The binder resin and any other component that are soluble in the organic solvent may be thereby dissolved in the organic solvent, whereas the fluorescent pigment that is insoluble in the organic solvent may be undissolved in the organic solvent. A resultant solution, therefore, may include a soluble component, such as the binder resin, and an insoluble component, such as the fluorescent pigment. Thereafter, the solution may be centrifugated using a centrifugal separator.

Thereafter, the solution may be analyzed by means of liquid chromatography, for example, to measure a weight M2 of the insoluble component, such as the fluorescent pigment, contained in the solution. In this measurement, the value of the weight M2 may be rounded to one decimal place.

Finally, the content of the fluorescent pigment may be calculated on the basis of the weights M1 and M2. The content (wt %) of the fluorescent pigment may be calculated by the expression M2/M1×100.

In a case where a type of the fluorescent pigment contained in the toner base particle is unknown, the content of the fluorescent pigment may be calculated through the procedure described above. On the other hand, in a case where a type of the fluorescent pigment contained in the toner base particle is known, the content of the fluorescent pigment may also be calculated through an alternative procedure described below.

In a case where a type of the fluorescent pigment is known, the weight M1 of the toner base particles may be measured first through the procedure described above. Thereafter, the toner base particles may be irradiated with an ultraviolet ray to cause the fluorescent pigment in each of the toner base particles to emit light. The wavelength and intensity of the light emitted from the fluorescent pigment may be measured using a spectrophotometer, and the weight M2 of the fluorescent pigment may be determined on the basis of the wavelength and the intensity of the light. Finally, the content of the fluorescent pigment may be calculated on the basis of the weights M1 and M2 through the procedure described above. Note that the respective values of the weights M1 and M2 may be rounded to one decimal place, as described above.

[Ratio Between Two Particle Size Distributions]

A description given below focuses on a particle size distribution on a volume basis Dw50 (μm) of the toner particles and a particle size distribution on a number basis Dn50 (μm) of the toner particles. The ratio of the particle size distribution on a number basis Dn50 to the particle size distribution on a volume basis Dw50 is within a range from about 0.66 to about 1.00. A luminescent image formed using such a luminescent toner is likely to cause uniform light emission and thus unlikely to cause uneven light emission. The ratio calculated by Dn50/Dw50 is hereinafter referred to as "particle size distribution ratio D".

In detail, in a case where the particle size distribution ratio D is smaller than about 0.66, such an excessively large particle size distribution of toner particles before classification can result in an excessively small occupancy ratio of toner particles having a desired average particle size. This is likely to cause variations in the light-emission amount of the fluorescent pigment contained in each of the toner particles, resulting in a difficulty in achieving uniform light emission of the luminescent image, which may lead to uneven light emission.

In contrast, in a case where the particle size distribution ratio D is not smaller than about 0.66, such a properly small particle size distribution of the toner particles before classification may result in a properly high occupancy ratio of the toner particles having a desired average particle size. This suppresses variations in the light-emission amount of the fluorescent pigment contained in each of the toner particles, resulting in uniform light emission of the luminance image, which suppresses uneven light emission.

The particle size distribution ratio D may be calculated on the basis of the results of the measurements of the particle size distribution on a volume basis of the toner particles and the particle size distribution on a number basis of the toner particle, as described above. The procedures for measuring these particle size distributions and calculating the particle size distribution ration D are described in detail below.

To calculate the particle size distribution ratio D, the particle size distribution on a volume basis Dw50 (μm) of the toner particles may be measured first by means of the particle size analyzer, which may be, for example, coulter counter Multisizer 3 available from Beckman Coulter, Inc., located in Indiana, the United States of America.

To prepare a measurement sample, a toner dispersion may be obtained by dispersing the toner particles in a dispersant, and thereafter a small amount of the toner dispersion may be added to an electrolyte. The dispersant may be, for example, a mixture of 95 mass % of a liquid dilution agent and 5 mass % of an ether type nonionic surfactant. The liquid dilution agent may be, for example, ISOTON II (registered trademark) available from Beckman Coulter, Inc., located in Indiana, the United States of America. The ether type nonionic surfactant may be, for example, Emulgen (registered trademark) available from Kao Corporation, located in Tokyo, Japan. The electrolyte may be, for example, ISOTON II described above. The toner particles in the measurement sample may have a concentration of, for example, about 10 wt %.

To measure the particle size distribution on a volume basis Dw50, an aperture diameter may be set to 100 μm, and the measurement may be completed at the timing when 30,000 or more toner particles in the measurement sample have been observed.

Thereafter, the particle size distribution on a number basis Dn50 (μm) of the toner particles may be measured by means of the particle size analyzer. Details of the type of the particle size analyzer, a procedure for preparing the measurement sample, and a procedure for measuring the particle size distribution on a number basis Dn50 may be similar to those for the measurement of the particle size distribution on a volume basis Dw50 described above.

Finally, the particle size distribution ratio D may be calculated on the basis of the results of the measurements of the particle size distribution on a volume basis Dw50 and the particle size distribution on a number basis Dn50. The particle size distribution ratio D may be calculated by the expression Dn50/Dw50.

[Conclusion]

It is apparent from the description above that the luminescent toner in which the content of the fluorescent pigment and the particle size distribution ratio D satisfy the respective conditions described above makes it possible to exhibit high luminescent characteristics, high light fastness, and high electric charging characteristics. Additionally, a luminescent image formed using such a luminescent toner is unlikely to cause uneven light emission.

[1.3 Manufacturing Method]

A method of manufacturing the luminescent toner will now be described.

The luminescent toner may be manufactured using any method without limitation. In one example described below, the luminescent toner may be manufactured using a dissolution suspension method.

[Preparation of Oil Phase]

To manufacture the luminescent toner using the dissolution suspension method, an oil phase may be prepared first. In one example, a polymeric dispersant may be first added and stirred in an organic solvent. The polymeric dispersant may be thereby dispersed or dissolved in the organic solvent, and a dispersant solution may be thereby obtained.

The organic solvent may include one or more of materials including ester, carbon hydride, halogenated hydrocarbon, alcohol, and ketone. The ester may be, for example, methyl acetate, ethyl acetate, or butyl acetate. The carbon hydride may be, for example, toluene or xylene. The halogenated hydrocarbon may be, for example, methylene chloride, chloroform, or dichloroethane. The alcohol may be, for example, methanol or ethanol. The ketone may be, for example, acetone, methyl ethyl ketone, or cyclohexanone. The details of the organic solvent described here may be applied to an organic solvent described below.

Thereafter, the fluorescent pigment may be added and stirred in the dispersant solution. The fluorescent pigment may be thereby dispersed in the dispersant solution, and a fluorescent dispersion may be thereby obtained. Thereafter, a binder resin may be added and stirred in the fluorescent dispersion. The binder resin may be dispersed or dissolved in the fluorescent dispersion, and a fluorescent solution may be thereby obtained. In this case, the fluorescent dispersion may be heated.

Thereafter, an organic solvent and other materials including the release agent and the electric charge control agent, may be added in this order and stirred in the fluorescent solution. The oil phase including the fluorescent pigment and the other materials may be thereby obtained. In this case, the organic solvent may be preliminarily heated.

In the example described above, the binder resin may be added first and thereafter the other materials may be added to the fluorescent dispersion. In an alternative example, the binder resin and the other materials may be added together to the fluorescent dispersion.

[Preparation of Aqueous Phase]

Thereafter, an inorganic dispersant, such as a suspension stabilizer, may be added and stirred in an aqueous medium. The inorganic dispersant may be dispersed or dissolved in the aqueous medium, and an aqueous phase may be thereby obtained.

The aqueous medium may include, for example, one or more of materials including pure water. The inorganic dispersant may include, for example, one or more of inorganic materials including trisodium phosphate, tricalcium phosphate, hydroxyapatite, calcium carbonate, calcium chloride, titanium oxide, aluminum hydroxide, magnesium hydroxide, barium sulfate, and silica. The silica may be, for example, silicon dioxide.

[Granulation]

Thereafter, granulation may be performed using the oil phase and the aqueous phase that are described above. In this case, the oil phase may be first added and stirred in the aqueous phase. The aqueous phase and the oil phase may be mixed in any desirable ratio without limitation. The mixture of the oil phase and the aqueous phase may be thereby suspended and subjected to granulation, and slurry that includes a plurality of toner base particles may be thereby obtained. As described above, the toner base particles each include the fluorescent pigment and the binder resin, for example.

Thereafter, the slurry may be distilled under a reduced pressure, and the organic solvent included in the slurry may be thereby volatilized and removed. Thereafter, a pH regulator may be added and stirred in the slurry, and the inorganic dispersant may be thereby dissolved and removed. The pH regulator may include, for example, one or more of acids including nitric acid. Thereafter, the slurry may be dehydrated, and the toner base particles may be thereby collected from the slurry. The collected toner base particles may be washed by re-dispersing and stirring the toner base particles in pure water, for example.

Thereafter, the toner base particles may be dehydrated, dried, and thereafter classified.

[External Addition Process]

Thereafter, the external additive may be added to the toner base particles, and the mixture of the toner base particle and the external additive may be stirred. The toner base particles and the external additive may be mixed in any ratio without limitation. The external additive may be thereby fixed to a surface of each of the toner base particles.

Through the process described above, the luminescent toner may be completed that includes the toner particles each having the toner base particle on which the external additive is fixed.

[1-4 Example Workings and Example Effects]

Example workings and example effects of the luminescent toner will now be described.

In the luminescent toner according to an example embodiment of the technology, the content of the fluorescent pigment may be within a range from about 0.3 wt % to about 3.0 wt %, and the particle size distribution ratio D may be within a range from about 0.66 to about 1.00. In this example embodiment, the content of the fluorescent pigment may be appropriately adjusted, as described above. Hence, the luminescent toner exhibits high luminescent characteristics, high light fastness, and high electric charging characteristics. Additionally, the particle size distribution ratio D may be appropriately adjusted in this example embodiment. Hence, a luminescent image formed using the luminescent toner is unlikely to cause uneven light emission. Accordingly, it is possible to improve the quality of the luminescent image and thus to form a higher-quality luminescent image, compared with a case where the content of the fluorescent pigment and the particle size distribution ratio D do not satisfy the respective conditions described above.

In one example, the content of the fluorescent pigment may be adjusted within a range from about 0.5 wt % to about 3.0 wt %. This further improves the quality of the luminance image and thus provides more effective effects. Additionally, a high-quality luminescent image that emits green light may be formed with the use of the fluorescent pigment emitting green light.

[2. Image Forming Apparatus (Toner Container and Developing Unit)]

A description is given below of an image forming apparatus according to an example embodiment of the technology in which the luminescent toner described above is used.

A toner container and a developing unit according to an example embodiment of the technology may serve as a portion of the image forming apparatus described below. Accordingly, the toner container and the developing unit are described below together with the image forming apparatus.

The image forming apparatus according to this example embodiment may be a so-called electrophotographic full-color printer that forms a luminescent image on a print medium M described below using the luminescent toner. For example, the image forming apparatus may be of an intermediate transfer type that forms the luminescent image on the print medium M, for example, with the use of an intermediate transfer belt 41 described below. The print medium M is illustrated in FIG. 1.

The image forming apparatus may be mounted with, for example, a non-luminescent toner described below as well as the luminescent toner. The non-luminescent toner may have no luminescent characteristics and may be a typical colored toner that is used in an electrophotographic image forming apparatus to form a full-color image. The non-luminescent toner is not limited to a particular type. The non-luminescent toner may be a yellow toner, a magenta toner, a cyan toner, or a black toner, for example.

Such an image forming apparatus is able to form the luminescent image using the luminescent toner and also form a non-luminescent image or a usual color image using the non-luminescent toner, for example. In one example, the image forming apparatus may form the luminescent image using both the luminescent toner and the non-luminescent toner, for example.

Hereinafter, the luminescent toner and the non-luminescent toner are simply and collectively referred to as a "toner" when needed, besides being referred to by these individual terms. Likewise, the luminescent image and the non-luminescent image are hereinafter simply and collectively referred to as an "image" when needed, besides being referred to by these individual terms.

Note that the print medium M may include any material without limitation. The print medium M may include, for example but not limited to, one or more of materials including paper and a film.

[2-1 Overall Configuration]

A description is given first of an overall configuration of the image forming apparatus.

FIG. 1 illustrates an example planar configuration of the image forming apparatus. The image forming apparatus may convey the print medium M along conveyance routes R1 to R5 in the process of forming an image. Each of the conveyance routes R1 to R5 is illustrated by a dashed line in FIG. 1.

Referring to FIG. 1, the image forming apparatus may include a housing 1 that accommodates a tray 10, a feeding roller 20, a developing unit 30, a transfer section 40, a fixing section 50, conveying rollers 61 to 68, and conveyance-path switching guides 69 and 70, for example. The housing 1 may have a discharge opening 1H and a stacker 2. The print medium M on which an image has been formed by the image forming apparatus may be discharged from the discharge opening 1H to the stacker 2.

The image forming apparatus may be able to form an image on one side of the print medium M and may be able to form images on both sides of the print medium M, for example. In the following description of the image forming apparatus that forms an image only on one side of the print medium M, the side on which the image is formed is referred to as a "front surface" of the print medium M. Further, in the following description of the image forming apparatus that forms images on both sides of the print medium M, one side on which an image is formed is referred to as a "front surface" of the print medium M, and the other side on which another image is formed, i.e., a surface opposite to the front surface described above, is referred to as a "back surface" of the print medium M.

[Tray and Feeding Roller]

The tray 10 may contain the print medium M. The tray 10 may be detachably attached to the housing 1, for example. The feeding roller 20 may be, for example, a cylindrical member that extends in a direction crossing the drawing plane of FIG. 1, and is rotatable around its axis extending in the direction crossing the drawing plane of FIG. 1, for example.

Out of components of the image forming apparatus described below, each of the components referred by a term that includes "roller" may be a cylindrical member that extends in the same direction as the feeding roller 20 and is rotatable in a similar fashion to the feeding roller 20.

The tray 10 may contain a stack of print media M, for example. The print media M contained in the tray 10 may be picked out one by one from the tray 10 by the feeding roller 20, for example.

Any number of the trays 10 may be provided without limitation. For example, only one tray 10 may be provided or two or more trays 10 may be provided. Likewise, any number of the feeding rollers 20 may be provided without limitation. For example, only one feeding rollers 20 may be provided or two or more feeding rollers 20 may be provided. In the example illustrated in FIG. 1, one tray 10 and one feeding roller 20 are provided.

[Developing Unit]

The developing unit 30 may perform a process of attaching the toner to an electrostatic latent image, i.e., a developing process. For example, the developing unit 30 may form the electrostatic latent image, and attach the toner to the electrostatic latent image by utilizing Coulomb force.

In this example, the image forming apparatus may include four developing units 30, i.e., developing units 30R, 30G, 30B, and 30K. The developing units 30R, 30G, 30B, and 30K each may be detachably attached to the housing 1 and may be arranged along a traveling path of the intermediate transfer belt 41 described below, for example. In this example, the developing units 30R, 30G, 30B, and 30K may be disposed in this order from upstream toward downstream in a traveling direction, illustrated by an arrow F5, of the intermediate transfer belt 41.

The developing units 30R, 30G, 30B, and 30K may have configurations similar to each other, except for having toners different from each other, for example. The toners may each be contained in a toner cartridge 32 described below with reference to FIG. 2.

In this example, four toners may be mounted in the image forming apparatus, for example. The four toners may include, for example, three luminescent toners, i.e., red, green, and blue toners, and one non-luminescent toner, i.e., a black toner.

The developing unit 30R may contain the red toner, for example. The developing unit 30G may contain the green toner, for example. The developing unit 30B may contain the blue toner, for example. The developing unit 30K may contain the black toner, for example. The developing units 30R, 30G, and 30B may each correspond to a "developing unit" in one specific but non-limiting embodiment of the technology.

A detailed configuration of each of the developing units 30R, 30G, 30B, and 30K is described below with reference to FIG. 2. A configuration of the non-luminescent toner, i.e., the black toner is also described below.

[Transfer Section]

The transfer section 40 may perform a transfer process of the toner that has been subjected to the developing process by the developing unit 30. For example, the transfer section 40 may transfer, onto the print medium M, the toner attached to the electrostatic latent image by the developing unit 30.

The transfer section 40 may include the intermediate transfer belt 41, a driving roller 42, a driven roller 43, a backup roller 44, a primary transfer roller 45, a secondary transfer roller 46, and a cleaning blade 47, for example.

The intermediate transfer belt 41 may be an intermediate transfer medium onto which the toner is temporarily transferred before the toner is transferred onto the print medium M. The intermediate transfer belt 41 may be an elastic endless belt, for example. The intermediate transfer belt 41 may be movable in the direction indicated by the arrow F5 in accordance with rotation of the driving roller 42, while lying on the driving roller 42, the driven roller 43, and the backup roller 44 in a stretched state, for example.

The driving roller 42 may be rotatable, for example, by utilizing power from a motor or other devices. Each of the driven roller 43 and the backup roller 44 may be rotatable in accordance with the rotation of the driving roller 42, for example.

The primary transfer roller 45 may transfer, onto the intermediate transfer belt 41, the toner attached to the electrostatic latent image. In other words, the primary transfer roller 45 may perform primary transfer. The primary transfer roller 45 may be so pressed against a photosensitive drum 312 as to be in contact with the photosensitive drum 312 with the intermediate transfer belt 41 in between. The photosensitive drum 312 is described below with reference to FIG. 2.

Any number of the primary transfer rollers 45 may be provided without limitation. For example, only one primary transfer roller 45 may be provided or two or more primary transfer rollers 45 may be provided. In this embodiment, the image forming apparatus may include four primary transfer rollers 45, primary transfer rollers 45R, 45G, 45B, and 45K that respectively correspond to the four developing units 30, i.e., the developing units 30R, 30G, 30B, and 30K. The image forming apparatus may also include one secondary transfer roller 46 that corresponds to the one backup roller 44.

The secondary transfer roller 46 may transfer, onto the print medium M, the toner transferred onto the intermediate transfer belt 41. In other words, the secondary transfer roller 46 may perform secondary transfer. The secondary transfer roller 46 may be so pressed against the backup roller 44 as to be in contact with the backup roller 44.

The cleaning blade 47 may be so pressed against the intermediate transfer belt 41 as to be in contact with the intermediate transfer belt 41. The cleaning blade 47 may scrape off an extraneous material such as unnecessary remains of the toner on the surface of the intermediate transfer belt 41.

[Fixing Section]

The fixing section 50 may perform a fixing process of the toner transferred onto the print medium M by the transfer section 40. For example, the fixing section 50 may apply a pressure onto the print medium M onto which the toner is transferred by the transfer section 40, while heating the print medium M. The fixing section 50 may thereby fix the toner to the print medium M.

The fixing section 50 may include a heating roller 51 and a pressure applying roller 52, for example. The heating roller 51 may beat the toner transferred onto the print medium M. A heating source, such as a heater, may be disposed in the heating roller 51, for example. Additionally, a temperature measuring device, such as a thermistor, may be so disposed in the vicinity of the heating roller 51 that the heating roller 51 and the temperature measuring device, such as the thermistor, may be spaced apart from each other, for example. The thermistor may measure a surface temperature of the heating roller 51. The pressure applying roller 52 may be so pressed against the heating roller 51 as to be in contact with the heating roller 51. The pressure applying roller 52 may apply a pressure onto the toner transferred onto the print medium M.

[Conveying Roller]

Each of the conveying rollers 61 to 68 may include a pair of rollers that face each other with corresponding one of the conveyance routes R1 to R5 in between. Each of the conveying rollers 61 to 68 may convey the print medium M taken out by the feeding roller 20.

In the case where the image is to be formed only on one side of the print medium M, i.e., only on the front surface of the print medium M, the print medium M may be conveyed by the conveying rollers 61 to 64 along the conveyance routes R1 and R2, for example. In the case where the images are to be formed on both sides of the print medium M, i.e., on both the front surface and the back surface of the print medium M, the print medium M may be conveyed by the conveying rollers 61 to 68 along the conveyance routes R1 to R5, for example.

[Conveyance-Path Switching Guide]

The conveyance-path switching guides 69 and 70 each may switch a conveyance direction, of the print medium M, in which the print medium M is to be conveyed, depending on a form of the image to be formed on the print medium M. Non-limiting examples of the form of the image to be formed on the print medium M may include a one-side image formation mode in which the image is to be formed only on one side of the print medium M, and a both-side image forming mode in which the images are to be formed on both sides of the print medium M.

[2-2 Configuration of Developing Unit]

A description is given below of a configuration of the developing unit 30. FIG. 2 is an enlarged plan view of the developing unit 30, i.e., each of the developing units 30R, 30G, 30B, and 30K, illustrated in FIG. 1.

As described above, the developing units 30R, 30G, 30B, and 30K may have configurations similar to each other, except for having toners different from each other, for example. The toners of the developing units 30R, 30G, 30B, and 30K may each be contained in the toner cartridge 32, for example.

Figure 2:
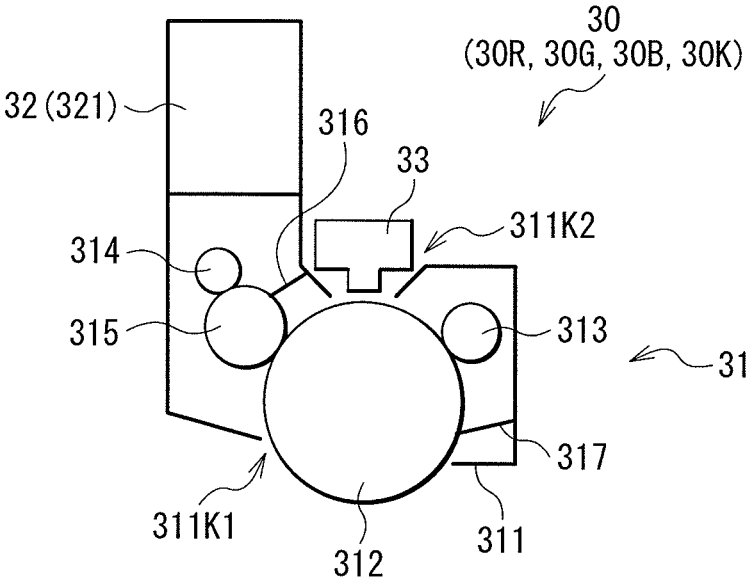
FIG. 2 is an enlarged plan view of a developing unit illustrated in FIG. 1.

For example, referring to FIG. 2, the developing units 30R, 30G, 30B, and 30K each may include a developing process section 31 and the toner cartridge 32, for example. The developing process section 31 may be provided with a light source 33, for example. The developing process section 31 included in each of the developing units 30R, 30G, and 30B may correspond to a "developing process section" in one specific but non-limiting embodiment of the technology. The toner cartridge 32 included in each of the developing units 30R, 30G, and 30B may correspond to a "toner container" in one specific but non-limiting embodiment of the technology.

[Developing Process Section]

The developing process section 31 may perform the developing process using the toner contained in the toner cartridge 32. The developing process section 31 may include a housing 311 that accommodates the photosensitive drum 312, a charging roller 313, a feeding roller 314, a developing roller 315, a developing blade 316, and a cleaning blade 317, for example.

The housing 311 may have an opening 311K1 from which the photosensitive drum 312 is partially exposed, for example. The housing 311 may also have an opening 311K2 that guides, to the photosensitive drum 312, light outputted from the light source 33, for example. The toner cartridge 32 may detachably attached to the housing 311, for example. The light source 33 may be disposed outside the housing 311, for example.

[Photosensitive Drum. Charging Roller, Feeding Roller, and Developing Roller]

The photosensitive drum 312 may be a cylindrical organic photoreceptor that carries the electrostatic latent image formed thereon. The photosensitive drum 312 may be a cylindrical member that extends in a similar fashion to the feeding roller 20 described above and that is rotatable in a similar fashion to the feeding roller 20 described above. The charging roller 313 may be so pressed against the photosensitive drum 312 as to be in contact with the photosensitive drum 312. The charging roller 313 may electrically charge a surface of the photosensitive drum 312. The feeding roller 314 may be so pressed against the developing roller 315 as to be in contact with the developing roller 315. The feeding roller 314 may feed the toner to a surface of the developing roller 315. The developing roller 315 may be so pressed against the photosensitive drum 312 as to be in contact with the photosensitive drum 312. The developing roller 315 may carry the toner that is fed from the feeding roller 314, and attach the fed toner onto the electrostatic latent image formed on the surface of the photosensitive drum 312.

[Developing Blade]

The developing blade 316 may be a plate-like member that controls the thickness of the toner fed to the surface of the developing roller 315. The developing blade 316 may be disposed at a position away from the developing roller 315 by a predetermined distance or space. The thickness of the toner may be controlled on the basis of the distance or space between the developing roller 315 and the developing blade 316.

[Cleaning Blade]

The cleaning blade 317 may be a plate-like elastic member that scrapes off an extraneous material such as unnecessary remains of the toner on the surface of the photosensitive drum 312. The cleaning blade 317 may extend in a direction substantially parallel to a direction in which the photosensitive drum 312 extends, for example. The cleaning blade 317 may be so pressed against the photosensitive drum 312 as to be in contact with the photosensitive drum 312.

[Toner Cartridge]

The toner cartridge 32 may contain the toner. The toner cartridge 32 may include a toner-containing receptacle 321 that contains the toner. The toner contained in the toner-containing receptacle 321 may be fed to the developing process section 31 as needed. The toner-containing receptacle 321 in the toner cartridge 32 that is included in each of the developing units 30R, 30G, and 30B may correspond to a "container section" in one specific but non-limiting embodiment of the technology.

The black toner contained in the toner cartridge 32 of the developing unit 30K may have a configuration similar to that of the luminescent toner except for including the black pigment instead of the fluorescent pigment, for example. The black pigment may be, for example, carbon black.

[Light Source]

The light source 33 may be an exposure device that performs exposure on the surface of the photosensitive drum 312 to thereby form the electrostatic latent image on the surface of the photosensitive drum 312. The light source 33 may be, for example, a light-emitting diode (LED) head that includes components such as an LED element or a lens array. The LED element and the lens array may be so disposed that the light outputted from the LED element forms an image on the surface of the photosensitive drum 312, for example.

[2-3. Operation]

A description is given below of an example operation of the image forming apparatus.

When an image is to be formed on the print medium M, the image forming apparatus may perform a developing process, a primary transfer process, a secondary transfer process, and a fixing process in this order as described below, for example. Optionally, the image forming apparatus may also perform a cleaning process.

In the following description, an example case is described where a green luminescent image is formed on the print medium M using the luminescent toner that is contained in the developing unit 30G, i.e., the green toner.

[Developing Process]

In the case of forming the luminescent image on the print medium M, first, the print medium M contained in the tray 10 may be picked up by the feeding roller 20. The print medium M picked up by the feeding roller 20 may be conveyed by the conveying rollers 61 and 62 along the conveyance route R1 in a direction indicated by an arrow F1.

The developing process may involve the operation performed in the developing process section 31 of the developing unit 30G as described below. In the developing process section 31 of the developing unit 30G, the charging roller 313 may apply a direct-current voltage to the surface of the photosensitive drum 312 while rotating in accordance with the rotation of the photosensitive drum 312, and thereby electrically charge the surface of the photosensitive drum 312 uniformly.

Thereafter, the light source 33 may emit light to the surface of the photosensitive drum 312 on the basis of image data. A surface potential in a region, of the photosensitive drum 312, irradiated with the light may be thereby attenuated. In other words, optical attenuation may occur in the region irradiated with the light. An electrostatic latent image may be thereby formed on the surface of the photosensitive drum 312. It is to be noted that the image data described above may be transmitted to the image forming apparatus from an external apparatus such as a personal computer, for example.

In the developing unit 30G, the green toner contained in the toner cartridge 32 may be fed to a surface of the feeding roller 314 in response to application of a voltage to the feeding roller 314.

When receiving a voltage, the developing roller 315 may rotate while being so pressed against the feeding roller 314 as to be in contact with the feeding roller 314. The green toner fed to the surface of the feeding roller 314 may be thereby attached to the surface of the developing roller 315. In this case, the green toner attached to the surface of the developing roller 315 may be partially removed by the developing blade 316. This uniformizes the thickness of the green toner attached to the surface of the developing roller 315.

After the photosensitive drum 312 rotates while being so pressed against the developing roller 315 as to be in contact with the developing roller 315, the green toner attached to the surface of the developing roller 315 may be moved onto the surface of the photosensitive drum 312. The green toner may be thereby attached to the surface of the photosensitive drum 312, i.e., to the electrostatic latent image.

[Primary Transfer Process]

When the driving roller 42 rotates in the transfer section 40, each of the driven roller 43 and the backup roller 44 may rotate in accordance with the rotation of the driving roller 42. This may cause the intermediate transfer belt 41 to travel in the direction indicated by the arrow F5.

The primary transfer process may involve application of a voltage to the primary transfer roller 45G that is so pressed against the photosensitive drum 312 as to be in contact with the photosensitive drum 312 with the intermediate transfer belt 41 in between. The green toner attached to the surface of the photosensitive drum 312, i.e., to the electrostatic latent image, in the foregoing developing process may be thereby transferred onto the intermediate transfer belt 41.

[Secondary Transfer Process]

The print medium M being conveyed along the conveyance route R1 may pass between the backup roller 44 and the secondary transfer roller 46. The secondary transfer process may involve application of a voltage to the secondary transfer roller 46 that is so pressed against the backup roller 44 as to be in contact with the backup roller 44 with the print medium M in between. The green toner transferred onto the intermediate transfer belt 41 in the foregoing primary transfer process may be thereby transferred onto the print medium M.

[Fixing Process]

After the green toner is transferred onto the print medium M in the secondary transfer process, the print medium M may be continuously conveyed along the conveyance route R1 in the direction indicated by the arrow F1, and thus conveyed to the fixing section 50. The fixing process may involve heating the green toner transferred onto the print medium M when the print medium M passes between the heating roller 51 and the pressure applying roller 52. The green toner may be melted by the heating and the green toner melted may be so pressed against the print medium M as to be attached closely to the print medium M.

As a result, the green toner may be fixed to the print medium M, resulting in formation of the green luminescent image on the print medium M. The print medium M on which the luminescent image is formed may be conveyed by the conveying rollers 63 and 64 along the conveyance route R2 in a direction indicated by an arrow F2. Thereafter, the print medium M may be discharged from the discharge opening 1H to the stacker 2.

In the foregoing example embodiment, the luminescent image is formed using the luminescent toner, i.e., the green luminescent toner, by the image forming apparatus. It is to be noted that the image forming apparatus may be able to form the luminescent image using any one or more of the three luminescent toners, i.e., the red toner, the green toner, and the blue toner, as described above. Furthermore, the image forming apparatus may be able to form the non-luminescent image using the non-luminescent toner, i.e., black toner. The image forming apparatus may be also able to form the luminescent image using one or more of the luminescent toners and the non-luminescent toner in combination, as described above. In these cases, the operations of the developing units 30R, 30B, and 30K may be similar to that of the developing unit 30G described above.

It is to be noted that whether the developing process is performed by each of the developing units 30R, 30G, 30B, and 30K may be determined depending on a combination of colors required for the formation of an image. For example, to form a monochrome non-luminescent image, the developing process may be performed only by the developing unit 30K. To form a full-color luminescent image, for example, the developing process may be performed by each of the developing units 30R, 30G, and 30B, or may be performed by each of the developing units 30R, 30G, 30B, and 30K.

[Procedure of Conveying Print Medium]

For example, in a case where luminescent images are to be formed on both sides of the print medium M, the print medium M that has passed through the fixing section 50 may be conveyed by the conveying rollers 65 to 68 along the conveyance routes R3 to R5 in directions indicated by respective arrows F3 and F4, and thereafter conveyed again by the conveying rollers 61 and 62 along the conveyance route R1 in the direction indicated by the arrow F1. In this case, the direction in which the print medium M is to be conveyed may be controlled by the conveyance-path switching guides 69 and 70. This may allow the back surface of the print medium M, i.e., the surface on which no luminescent image has been formed yet, to be subjected to the developing process, the primary transfer process, the secondary transfer process, and the fixing process.

[Cleaning Process]

An extraneous material such as unnecessary remains of the toner may sometimes be present on the surface of the photosensitive drum 312 in the developing unit 30. The unnecessary remains of the toner may be, for example, part of the toner that has been used in the primary transfer process, which may be, for example, the toner that has remained on the surface of the photosensitive drum 312 without being transferred onto the intermediate transfer belt 41.

To address this, the photosensitive drum 312 may rotate while being so pressed against the cleaning blade 317 as to be in contact with the cleaning blade 317 in the developing unit 30. This may cause the extraneous material such as the remains of the toner present on the surface of the photosensitive drum 312 to be scraped off by the cleaning blade 317. As a result, the extraneous material may be removed from the surface of the photosensitive drum 312.

Further, in the transfer section 40, part of the toner that has been moved onto the surface of the intermediate transfer belt 41 in the primary transfer process may sometimes not be moved onto the surface of the print medium M in the secondary transfer process and may remain on the surface of the intermediate transfer belt 41.

To address this, the cleaning blade 47 may scrape off the remains of the toner present on the surface of the intermediate transfer belt 41 in the transfer section 40 upon traveling of the intermediate transfer belt 41 in the direction indicated by the arrow F5. As a result, unnecessary remains of the toner may be removed from the surface of the intermediate transfer belt 41.

[2-4. Example Workings and Example Effects]

According to the image forming apparatus of an example embodiment of the technology, the luminescent toner described above may be mounted thereon. This improves the quality of a luminescent image, as described above. Accordingly, it is possible to improve the quality of the luminescent image and thus to form a higher-quality luminescent image. The example workings and example effects described above may be obtained also in the toner cartridge 32 that contains the luminescent toner. Furthermore, the example workings and example effects described above may be obtained also in the developing unit 30 (i.e., each of the developing unit 30R, 30G, and 30B) that is mounted with the luminescent toner.

Other example workings and other example effects related to each of the image forming apparatus, the toner cartridge 32, and the developing unit 30 (i.e., each of the developing unit 30R, 30G, or 30B) may be similar to those related to the luminescent toner described above.

[3. Modification Examples]

The configuration of the image forming apparatus described above may be modified where appropriate.

[Modification Example 1]

In the example described above, the image forming apparatus may be Mounted with both the luminescent toner and the non-luminescent toner; however, the type of the toner to be mounted on the image forming apparatus may be modified as desired as long as formation of the luminescent image with the use of one or more of the luminescent toners is allowed thereby.

For example, the image forming apparatus may be mounted only with the luminescent toner and without the non-luminescent toner. In this case, the image forming apparatus may be mounted with only one or two of the three luminescent toners, i.e., the red toner, the green toner, and the blue toner, for example.

Furthermore, in the case where the image forming apparatus is mounted with both the luminescent toner and the non-luminescent toner, the type of the non-luminescent toner may be modified as desired. For example, the image forming apparatus may be mounted with four types of non-luminescent toners, which may include a yellow toner, a magenta toner, a cyan toner, and a black toner, to form a full-color non-luminescent image. Alternatively, the image forming apparatus may be mounted with three types of non-luminescent toners, which may include the yellow toner, the magenta toner, and the cyan toner.

The yellow toner may have, for example, a configuration similar to that of the black toner except for including one or more of yellow pigments including a pigment yellow 74, instead of the black pigment. The magenta toner may have, for example, a configuration similar to that of the black toner except for including one or more of magenta pigments including quinacridone, instead of the black pigment. The cyan toner may have, for example, a configuration similar to that of the black toner except for including one or more of cyan pigments including phthalocyanine blue, instead of the black pigment.

The image forming apparatus in the above-described cases also allows for formation of higher-quality luminescent image using the luminescent toner. Hence, it is possible to obtain effects similar to those described above.

[Modification Example 2]

Figure 3:
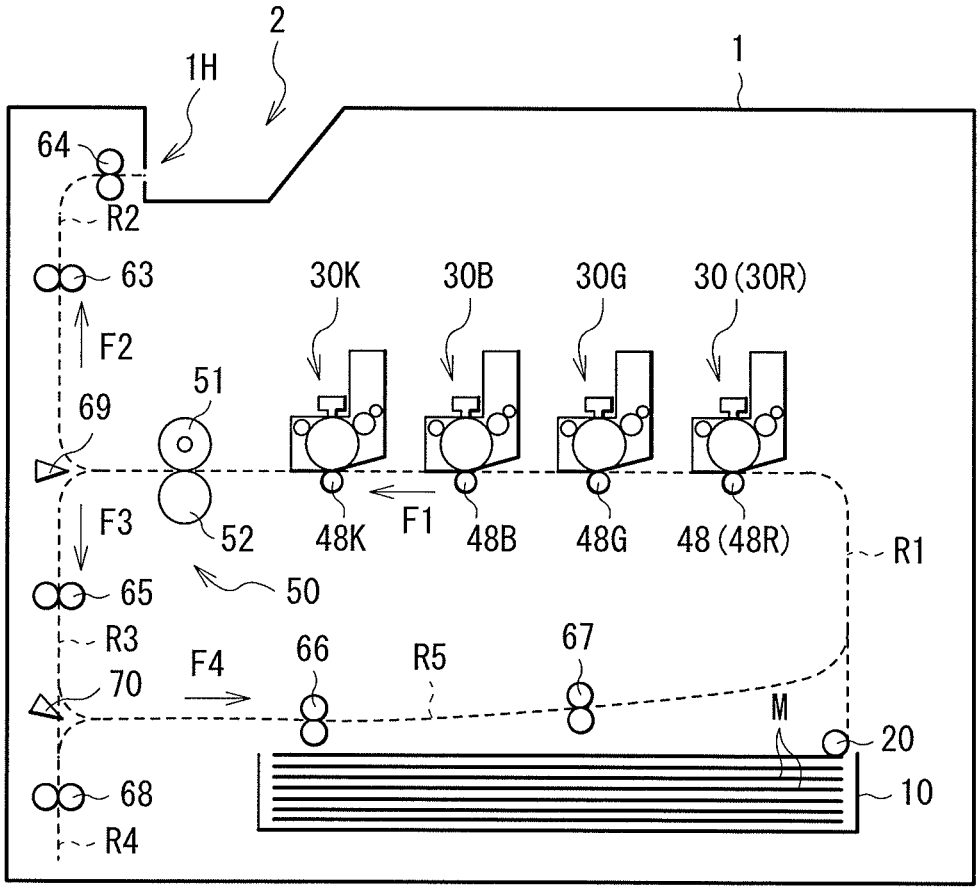
FIG. 3 is a plan view of an image forming apparatus having an example configuration according to a modification example.

In the above description, the image forming apparatus may be of the intermediate-transfer type that forms an image on the print medium M by means of the intermediate transfer belt 41. Alternatively, the image forming apparatus may be of a direct-transfer type that forms an image on the print medium M without using the intermediate transfer belt 41, as illustrated in FIG. 3, which corresponds to FIG. 1.

The image forming apparatus of the direct-transfer type may have a configuration similar to that of the image forming apparatus of the intermediate-transfer type illustrated in FIG. 1 except for the following points, for example.

Firstly, the image forming apparatus of the direct-transfer type may include, instead of the transfer section 40, four transfer rollers 48, i.e., transfer rollers 48R, 48G, 48B, and 48K, corresponding to four primary transfer rollers 45, i.e., primary transfer rollers 45R, 45G, 45B, and 45K. Secondly, the developing units 30, i.e., the developing units 30R, 30G, 30B, and 30K, and the transfer rollers 48, i.e., the transfer rollers 48R, 48G, 48B, and 48K may be arranged along the conveyance route R1. Thirdly, the developing units 30R, 30G, 30B, and 30K may be disposed, for example, in this order from upstream to downstream in a direction in which the print medium M is to be conveyed along the conveyance route R1. Additionally, the transfer rollers 48R, 48G, 48B, and 48K may be disposed, for example, in this order from upstream to downstream in a direction in which the print medium M is to be conveyed along the conveyance route R1. The transfer rollers 48, i.e., the transfer rollers 48R, 48G, and 48B may correspond to a "transfer section" in one specific but non-limiting embodiment of the technology.

An operation of the image forming apparatus of the direct-transfer type may be, for example, similar to that of the image forming apparatus of the intermediate-transfer type except for performing a transfer process instead of the primary transfer process and the secondary transfer process. Details of the transfer process may be similar to those of the primary transfer process. In other words, the transfer process may involve transfer, onto the print medium M, of the toner that has been attached to an electrostatic latent image in the developing process.

The image forming apparatus of the direct-transfer type described above also allows for formation of higher-quality luminescent image using the luminescent toner. Hence, it is possible to obtain effects similar to those described above. Other example workings and other example effects related to the image forming apparatus of the direct-transfer type may be similar to those related to the image forming apparatus of the intermediate-transfer type.

[Working Examples]

A detailed description is given below of working examples of an example embodiment of the technology.

[Experiment Examples 1 to 13]

Firstly, the luminescent toner, which was the green toner, was manufactured through the following procedure. Thereafter, a luminescent image was formed using the luminescent toner manufactured. The luminescent toner and the luminescent image, i.e., a green luminescent image, were evaluated.

[Manufacturing of Luminescent Toner]

The luminescent toner was manufactured by the dissolution suspension method through the following procedure.

[Preparation of Oil Phase]

To prepare the oil phase, X g of an organic solvent at a temperature of 60° C. was prepared first. The organic solvent used was ethyl acetate, available from Taiyo Kagaku Co., Ltd., located in Tokyo, Japan. Thereafter, 0.39 g of a release agent and Y g of a fluorescent pigment were added in this order to the organic solvent, while the organic solvent was stirred. The release agent used was Paraffin Wax SP-0145 available from Nippon Seiro Co., Ltd., located in Tokyo, Japan. The fluorescent pigment used was SINLOIHI COLOR FZ-5012 (green), available from SINLOIHI Co., Ltd., located in Kanagawa, Japan. The mixing ratio X (g) of the organic solvent and the mixing ratio Y (g) of the fluorescent pigment were set as described in Table 1. Thereafter, 14.5 g of a binder resin was added and stirred in the organic solvent until a solid component was disappeared. The binder resin used was polyester available from Kao Corporation, located in Tokyo, Japan. As a result, the oil phase including the organic solvent, the fluorescent pigment, the binder resin, and the release agent was obtained.

TABLE 1

| Experiment example | Mixing ratio (g) Fluorescent pigment | Binder resin | Release agent | Organic solvent | Content of fluorescent pigment (wt %) | Mixing ratio of fluorescent pigment (wt %) | Particle size distribution ratio D | Luminescent characteristics | Light fastness | Electric charging characteristics | Uniformity |
|---|---|---|---|---|---|---|---|---|---|---|---|
| 1 | 0 | 14.5 | 0.39 | 60 | 0 | 0 | — | — | — | — | — |
| 2 | 0.01 | 14.5 | 0.39 | 60 | 0.1 | 0.1 | — | D | C | A | — |
| 3 | 0.05 | 14.5 | 0.39 | 60 | 0.3 | 0.3 | — | C | B | A | — |
| 4 | 0.08 | 14.5 | 0.39 | 60 | 0.5 | 0.6 | — | B | A | A | — |
| 5 | 0.29 | 14.5 | 0.39 | 60 | 1.9 | 2.0 | — | B | A | A | — |
| 6 | 0.46 | 14.5 | 0.39 | 50 | 3.0 | 3.2 | 0.51 | A | A | A | B |
| 7 | 0.46 | 14.5 | 0.39 | 60 | 3.0 | 3.2 | 0.66 | A | A | A | A |
| 8 | 0.46 | 14.5 | 0.39 | 70 | 3.0 | 3.2 | 0.78 | A | A | A | A |
| 9 | 0.46 | 14.5 | 0.39 | 100 | 3.0 | 3.2 | 0.82 | A | A | A | A |
| 10 | 0.46 | 14.5 | 0.39 | 120 | 3.0 | 3.2 | 1.00 | A | A | A | A |
| 11 | 0.64 | 14.5 | 0.39 | 60 | 4.1 | 4.4 | — | A | A | B | — |
| 12 | 0.80 | 14.5 | 0.39 | 60 | 5.1 | 5.5 | — | A | A | B | — |
| 13 | 0.95 | 14.5 | 0.39 | 60 | 6.0 | 6.6 | — | A | A | B | — |

*Content of fluorescent pigment = (weight of fluorescent pigment/weight of toner base particle) × 100
*Mixing proportion of fluorescent pigment = (weight of fluorescent pigment/weight of binder resin) × 100

[Preparation of Aqueous Phase]

To prepare an aqueous phase, 10.2 g of an inorganic dispersant was added first to 300 g of an aqueous medium, and thereafter the mixture was heated up to 60° C. The inorganic dispersant used was trisodium phosphate dodecahydrate for industrial use, available from Taiyo Chemical Industry Co., Ltd., located in Tokyo, Japan. The aqueous medium used was pure water. The inorganic dispersant was thereby dissolved in the aqueous medium. As a result, a first inorganic dispersion aqueous solution was obtained. Thereafter, acid directed to pH adjustment was added to the first inorganic dispersion aqueous solution. The acid used was 20% dilute nitric acid available from Wako Chemicals, located in Gunma, Japan. The pH of the first inorganic dispersion aqueous solution was thereby adjusted within a range from 7.2 to 7.5.

Additionally, 4.92 g of an inorganic dispersant was added to 50 g of an aqueous medium, and thereafter the mixture was heated up to 60° C. The inorganic dispersant used was calcium chloride anhydrous for industrial use, available from Tokuyama Corporation, located in Tokyo, Japan. The aqueous medium used was pure water. The inorganic dispersant was thereby dissolved in the aqueous medium. As a result, a second inorganic dispersion aqueous solution was obtained.

Thereafter, the second inorganic dispersion aqueous solution was added to the first inorganic dispersion aqueous solution. The mixture at a temperature of 60° C. was subjected to a high-speed stirring by means of a stirrer at a rotation speed of 10,000 rpm for five minutes. The stirrer used was Neo Mixer (registered trademark) available from Primix Corporation, located in Hyogo, Japan. As a result, the aqueous phase including the aqueous medium and the inorganic dispersant was obtained.

[Granulation]

To perform granulation with the use of the oil phase and the aqueous phase, firstly, 2.5 $cm^3$, which is equal to 2.5 ml, of a surfactant was added and stirred in the aqueous phase at a temperature of 60° C. The surfactant used was Neogen (registered trademark) S-20F, available from DKS Co. Ltd., located in Kyoto, Japan. Thereafter, the oil phase was added to the aqueous phase containing the surfactant, and the mixture or mixed phase was stirred by the stirrer described above at a rotation speed 8,000 rpm for 30 seconds. The mixed phase was thereby suspended and granulated. As a result, slurry containing a plurality of toner base particles was obtained. The toner base particles each included the fluorescent pigment, the binder resin, and the release agent that are described above.

Thereafter, the slurry at a temperature of 60° C. was distilled under a reduced pressure. The organic solvent was thereby volatilized and removed. Thereafter, the slurry was cooled, and a pH regulator was so added to the slurry that the pH of the slurry was adjusted to be equal to or lower than 1.6. The pH regulator used was nitric acid. The inorganic dispersant was thereby dissolved and removed. Thereafter, the slurry was dehydrated. The toner base particles were thereby collected from the slurry. Thereafter, the collected toner base particles were re-dispersed and stirred in pure water. Thereafter, the toner base particles were dehydrated and dried.

[External Addition Process]

To perform the external addition process on the toner base particles, a mixture of 20 g of the toner base particles and an external additive was put in a plastic container and shaken by means of a shaker at a speed of 125 rpm for three minutes. The shaker used was a shaker Model-YS-8D for versatile use, available from Yayoi. Co. Ltd., located in Tokyo, Japan.

The external additive used was a mixture of small particle size silica powder A, small particle size silica powder B, colloidal silica powder, and large particle size silica powder. The small particle size silica powder A used was hydrophobic fumed silica AEROSIL (registered trademark) NA200Y, available from Nippon Aerosil Co., Ltd., located in Tokyo, Japan. The small particle size silica powder B used was hydrophobic fumed silica AEROSIL (registered trademark) RY200, available from Nippon Aerosil Co., Ltd., located in Tokyo, Japan. The colloidal silica powder used was sol-gel silica X24-9163A available from Shin-Etsu Chemical Co., Ltd., located in Tokyo, Japan. The large particle size silica powder size used was hydrophobic fumed silica AEROSIL (registered trademark) RY50, available from Nippon Aerosil Co., Ltd., located in Tokyo, Japan.

The mixing ratio of the small particle size silica powder A was 0.1 wt % relative to the weight of the toner base particles. The mixing ratio of the small particle size silica powder B was 0.62 wt % relative to the weight of the toner base particles. The mixing ratio of the colloidal silica powder was 2.22 wt % relative to the weight of the toner base particles. The Mixing ratio of the large particle size silica powder was 0.37 wt % relative to the weight of the toner base particles.

The external additive was thereby fixed onto the surface of each of the toner base particles. As a result, the luminescent toner was obtained. The obtained luminescent toner included the fluorescent pigment emitting green light, and thus emitted green light.

Note that the content (wt %) of the fluorescent pigment, the mixing ratio (wt %) of the fluorescent pigment, and the particle size distribution ratio D were as described in Table 1. The procedure for calculating the content of the fluorescent pigment was as described above. Additionally, the procedure for measuring and calculating the particle size distribution ratio D was as described above.

The content of the fluorescent pigment is a content of the fluorescent pigment in the toner base particle, as described above. Therefore, the content of the fluorescent pigment (wt %) was calculated by the expression (the weight of the fluorescent pigment/the weight of the toner base particle)×100.

The mixing ratio of the fluorescent pigment is a ratio of the weight of the fluorescent pigment to the weight of the binder resin. Therefore, the mixing ratio (%) of the fluorescent pigment was calculated by the expression (the weight of the fluorescent pigment/the weight of the binder resin)×100.

In the preparation of the oil phase, the content of the fluorescent pigment was adjusted by changing the mixing ratio of the fluorescent pigment. Additionally, in the preparation of the oil phase, the particle size distribution ratio D was adjusted by changing the mixing ratio of the organic solvent, i.e., the content of the binder resin in the oil phase. The particle size distribution ratio D increased as the content of the binder rein in the oil phase reduced, and the particle size distribution ratio D reduced as the content of the binder resin in the oil phase increased.

[Evaluation of Luminescent Toner and Luminescent Image]

The luminescent toner and the luminescent image formed using the luminescent toner were evaluated by the following procedure. Results of the evaluation are described in Table 1. In the evaluation, luminescent characteristics, light fastness, and electric charging characteristics were examined to thereby evaluate the luminescent toner, and uniformity was examined to thereby evaluate the luminescent image.

In Experiment Example 1 in which the fluorescent pigment was not used, the luminescent toner and the luminescent image were not able to emit light, as might be expected. Therefore, the luminescent characteristics, the light fastness, the electric charging characteristics, and the uniformity were not examined.

[Luminescent Characteristics]

To examine the luminescent characteristics, the luminescent toner was irradiated with an ultraviolet ray having a wavelength of about 200 nm to about 400 nm in a dark place at a temperature of 23° C. and a humidity of 50%. Thereafter, a luminescent state of the luminescent toner was visually observed.

As a result of the visual observation, the luminescent toner sufficiently emitting light was evaluated as "A". The luminescent toner emitting pale light was evaluated as "B". The luminescent toner slightly emitting light and luminescent state of which was within an allowable range was evaluated as "C". The luminescent toner emitting no light was evaluated as "D".

[Light Fastness]

A weatherometer was used to examine the light fastness of the luminescent toner in a condition where the temperature of a testing chamber was 40° C., a relative temperature was of 50° C., the wavelength of a light source was 340 nm, and irradiance was 0.36 W/m$^2$. The weatherometer used was Xenon Weather-Ometer (registered trademark) Ci4000 available from Atlas Material Testing Technology LLC located in Illinois, the United States of America. To prepare a test sample, the luminescent toner was put into a plastic sample bottle, and the plastic sample bottle was sealed with a plastic wrap. The test sample prepared was stood in a region irradiated with light from the light source. The test sample was taken out from the weatherometer every five hours to visually observe the luminescent state of the luminescent toner. The procedure for observing the luminescent state of the luminescent toner was as in the examination of the luminescent characteristics.

As a result of the examination, the luminescent toner sufficiently emitting light even after having been stood for 4320 hours or more (which equals to about six months) was evaluated as "A". The luminescent toner emitting pale light after having been stood for 4320 hours or more was evaluated as "B". The luminescent toner that stopped emitting light after having been stood for less than 4320 hours was evaluated as "C".

Note that the examination of the light fastness described above was a so-called acceleration test. For example, standing for one hour in the light-fastness examination described hereinabove may be equivalent to standing for 214 hours with being irradiated with a general fluorescent light.

[Electric Charging Characteristics]

To examine the electric charging characteristics, an image forming apparatus mounted with the luminescent toner was used in a normal-temperature environment at a temperature of 23° C. and a humidity of 50%. The image forming apparatus used was a color printer C941 available from OK1 Data Corporation located in Tokyo, Japan. With the use of the image forming apparatus, a solid luminescent image having a coverage rate of 100% was formed on a print medium, which was an A4 printer sheet P (thick) available from Fuji Xerox Co., Ltd., located in Tokyo, Japan. In the formation of the luminescent image, the print medium was conveyed in a traveling direction along a short side of the print medium, the image formation was performed at a rate of 18 ppm and a fixing temperature of 155° C., and the amount of the luminescent toner on the print medium was 0.40 mg/cm$^2$. In this examination, a voltage applied to the developing roller was fixed to about −185 V, and a voltage applied to the feeding roller was fixed to about −285 V, while a voltage applied to the charging roller was varied within a range from about −1020 V to about −1200 V to thereby form the luminescent image on the print medium. The state of the luminescent image formed was visually observed.

As a result, a case was evaluated as "A" where unintentional adhesion or so-called stain of the luminescent toner was not observed on a side downstream the luminescent image in the traveling direction of the print medium, and a case was evaluated as "B" where the stain was observed on the side downstream the luminescent image in the traveling direction of the print medium.

[Uniformity]

To examine the uniformity, a luminescent image was formed on a print medium through a procedure similar to that for the examination of the electric charging characteristics, except for changing the type of the luminescent image or image pattern from the solid image having a coverage rate of 100% to a halftone image having a coverage rate of 25%. The state of the luminescent image formed was visually observed.

As a result, the luminescent image uniformly emitting light without luminance unevenness was evaluated as "A". The luminescent image non-uniformly emitting light with luminance unevenness was evaluated as "B". The luminance unevenness may be a problem inherent to the luminescent toner having luminescent characteristics.

[Discussion]

As apparent from Table 1, the luminescent characteristics, the light fastness, the electric charging characteristics, and the uniformity were greatly varied depending on the composition of the luminescent toner, i.e., the content of the fluorescent pigment and the particle size distribution ratio D.

For example, in Experiment Example 2 in which the content of the fluorescent pigment was smaller than 0.3 wt %, the luminescent characteristics and the light fastness were insufficient. In contrast, in Experiment Examples 3 to 13 in which the content of the fluorescent pigment was 0.3 wt % or greater, the luminescent characteristics and the light fastness were improved.

Additionally, in Experiment Examples 11 to 13 in which the content of the fluorescent pigment was greater than 3.0 wt %, the electric charging characteristics were insufficient. In contrast, in Experiment Examples 2 to 10 in which the content of the fluorescent pigment was 3.0 wt % or smaller, the electric charging characteristics were improved.

Accordingly, the luminescent characteristics, light fastness, and electric charging characteristics were sufficient in the experiment examples in which the content of the fluorescent pigment was within a range from 0.3 wt % to 3.0 wt %.

It is to be noted that the luminance unevenness was observed and thus the uniformity was insufficient in Experiment Example 6 in which the particle size distribution ratio D was smaller than 0.66. In contrast, the luminance unevenness was not observed and thus the uniformity was sufficient in Experiment Examples 7 to 10 in which the particle size distribution ratio D was 0.66 or greater (e.g., within a range from 0.66 to 1.00).

Accordingly, the luminescent characteristics, light fastness, electric charging characteristics, and uniformity were sufficient in the experiment examples in which the content of the fluorescent pigment was in a range from 0.3 wt % to 3.0 wt % and the particle size distribution ratio D was within a range from 0.66 to 1.00. The luminescent characteristics and light fastness were further improved in the experiment examples in which the content of the fluorescent pigment was within a range from 0.5 wt % to 3.0 wt %.

As apparent from the results in Table 1, the luminescent characteristics, light fastness, electric charging characteristics, and uniformity were improved in the case where the content of the fluorescent pigment was within a range from 0.3 wt % to 3.0 wt % and the particle size distribution ratio D was within a range from 0.66 to 1.00. As a result, a high-quality luminescent image was able to be formed with the use of the luminescent toner.

Some example embodiments and the modification examples thereof of the technology have been described above; however, embodiments of the technology are not limited to the example embodiments and the modification examples described above, and are modifiable in various ways. For example, the image forming apparatus according to one embodiment of the technology is not limited to a printer, and may be any other apparatus such as a copying machine, a facsimile, or a multi-functional peripheral.

Furthermore, the technology encompasses any possible combination of some or all of the various embodiments and the modifications described herein and incorporated herein.

It is possible to achieve at least the following configurations from the above-described example embodiments of the technology.

(1)

A toner including a plurality of toner particles, the toner particles each including:

a toner base particle including a fluorescent pigment and a binder resin; and an external additive fixed on a surface of the toner base particle, a content of the fluorescent pigment in the toner base particle being equal to or greater than 0.3 weight percent and equal to or smaller than 3.0 weight percent, a ratio of a particle size distribution on a number basis of the toner particles to a particle size distribution on a volume basis of the toner particles being equal to or greater than 0.66 and equal to or smaller than 1.00.

(2)

The toner according to (1), in which the content of the fluorescent pigment in the toner base particle is equal to or greater than 0.5 weight percent and equal to or smaller than 3.0 weight percent.

(3)

The toner according to (1) or (2), in which the fluorescent pigment emits green light.

(4)

The toner according to (3), in which the green light has a wavelength equal to or greater than 495 nanometers and equal to or smaller than 570 nanometers.

(5)

A toner container including a container section containing the toner according to any one of (1) to (4).

(6)

A developing unit including:

the toner container according to (5); and a developing process section that performs a developing process using the toner contained in the toner container.

(7)

An image forming apparatus including:

the developing unit according to (6);

a transfer section that performs a transfer process using the toner on which the developing process has been performed by the developing unit; and a fixing section that performs a fixing process using the toner on which the transfer process has been performed by the transfer section.

(8)

A toner manufacturing method including:

forming toner base particles using a dissolution suspension method, the toner base particles each including a fluorescent pigment and a binder resin, a content of the fluorescent pigment in the toner base particle being equal to or greater than 0.3 weight percent and equal to or smaller than 3.0 weight percent; and fabricating a toner including a plurality of toner particles by fixing an external additive on a surface of each of the toner base particles, the plurality of toner particles each including the toner base particle and the external additive.

(9)

The toner manufacturing method according to (8), in which the content of the fluorescent pigment in the toner base particle is equal to or greater than 0.5 weight percent and equal to or smaller than 3.0 weight percent.

(10)

The toner manufacturing method according to (8) or (9), in which a ratio of a particle size distribution on a number basis of the toner particles to a particle size distribution on a volume basis of the toner particles is equal to or greater than 0.66 and equal to or smaller than 1.00.

According to any of the toner, the toner container, the developing unit, the image forming apparatus, and the toner manufacturing method of one embodiment of the technology, the content of the fluorescent pigment in the toner base particle satisfies the conditions described above, and the ratio of the particle size distribution on a number basis of the toner particles to the particle size distribution on a volume basis of the toner particles satisfies the conditions described above. Hence, it is possible to form a high-quality luminescent image.

Although the technology has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. A toner comprising a plurality of toner particles, the toner particles each including:

a toner base particle including a fluorescent pigment and a binder resin; and an external additive fixed on a surface of the toner base particle, a content of the fluorescent pigment in the toner base particle being equal to or greater than 0.3 weight percent and equal to or smaller than 3.0 weight percent based on a total weight of the toner base particle, wherein the content of the fluorescent pigment is calculated on the basis of an analysis by liquid chromatography of a solution in which the toner base particle is dissolved, a ratio of a particle size distribution on a number basis of the toner particles to a particle size distribution on a volume basis of the toner particles being equal to or greater than 0.66 and equal to or smaller than 1.00.

2. The toner according to claim 1, wherein the content of the fluorescent pigment in the toner base particle is equal to or greater than 0.5 weight percent and equal to or smaller than 3.0 weight percent.

3. The toner according to claim 1, wherein the fluorescent pigment emits green light.

4. The toner according to claim 3, wherein the green light has a wavelength equal to or greater than 495 nanometers and equal to or smaller than 570 nanometers.

5. A toner container comprising a container section containing the toner according to claim 1.

6. A developing unit comprising:

the toner container according to claim 5; and a developing process section that performs a developing process using the toner contained in the toner container.

7. An image forming apparatus comprising:

the developing unit according to claim 6;

a transfer section that performs a transfer process using the toner on which the developing process has been performed by the developing unit; and a fixing section that performs a fixing process using the toner on which the transfer process has been performed by the transfer section.

8. A toner manufacturing method comprising:

forming toner base particles using a dissolution suspension method, the toner base particles each including a fluorescent pigment and a binder resin, a content of the fluorescent pigment in the toner base particle being equal to or greater than 0.3 weight percent and equal to or smaller than 3.0 weight percent; and fabricating a toner including a plurality of toner particles by fixing an external additive on a surface of each of the toner base particles, the plurality of toner particles each including the toner base particle and the external additive.

9. The toner manufacturing method according to claim 8, wherein the content of the fluorescent pigment in the toner base particle is equal to or greater than 0.5 weight percent and equal to or smaller than 3.0 weight percent.

10. The toner manufacturing method according to claim 8, wherein a ratio of a particle size distribution on a number basis of the toner particles to a particle size distribution on a volume basis of the toner particles is equal to or greater than 0.66 and equal to or smaller than 1.00.

* * * * *